United States Patent [19]

Nikolaev et al.

[11] 4,363,365

[45] Dec. 14, 1982

[54] IMPACT TOOL WITH DAMPING CHAMBERS

[76] Inventors: Igor V. Nikolaev, ulitsa Fadeeva, 5, kv. 37; Vladimir A. Evpolov, ulitsa Papernika, 7, kv. 19, both of Moscow; Lidia M. Dronova, ulitsa Kalarash, 5, kv. 68, Ljubertsy Moskovskoi oblasti; Anatoly I. Lednikov, Korovinskoe shosse, 9, korpus 2, kv. 51; Mikhail A. Moskvin, Petrovsko-Razumovskaya alleya, 16, kv. 101, both of Moscow; Oleg Y. Sutyagin, ulitsa Dekabristov, 5, kv. 51, Sverdlovsk; Oleg A. Yankovsky, ulitsa Kuibysheva, 102, kv. 17, Sverdlovsk; Viktor E. Kilin, Posadskaya ulitsa, 44, korpus 2, kv. 40, Sverdlovsk; Evgeny S. Kolmyk, ulitsa 6 Okolotok, 1, Sverdlovsk; Konstantin K. Tupitsyn, Krasny prospekt, 51/3, kv. 25; Alexei M. Makarov, Vostochny poselok, 18a, kv. 16, both of Novosibirsk, all of U.S.S.R.

[21] Appl. No.: 126,562

[22] Filed: Mar. 3, 1980

[51] Int. Cl.[3] ..... B25D 17/24

[52] U.S. Cl. ..... 173/139

[58] Field of Search ..... 173/139, 114; 92/85 B

[56] References Cited

U.S. PATENT DOCUMENTS

| | | | |
|---|---|---|---|
| 3,266,581 | 8/1966 | Cooley et al. | 173/139 X |
| 4,109,734 | 8/1978 | Montabert | 173/139 X |

FOREIGN PATENT DOCUMENTS

| | | | |
|---|---|---|---|
| 40-28439 | 7/1965 | Japan | 173/139 |
| 52-32476 | 11/1977 | Japan | 92/85 B |
| 338362 | 5/1972 | U.S.S.R. . | |
| 181912 | 12/1977 | U.S.S.R. | 173/139 |
| 599068 | 2/1978 | U.S.S.R. | 173/139 |
| 712245 | 1/1980 | U.S.S.R. | 173/139 |

*Primary Examiner*—Werner H. Schroeder
*Assistant Examiner*—Andrew M. Falik
*Attorney, Agent, or Firm*—McAulay, Fields, Fisher, Goldstein & Nissen

[57] ABSTRACT

A pneumatic percussive tool has a barrel in which is inserted a hammer piston imparting blows at a working tool at regular intervals. A floating sleeve surrounding the working tool is provided in the front end portion of the barrel, the sleeve having a projection defining with a barrel groove a damping chamber communicating with a source of compressed gas. There is provided a shell rigidly secured to the barrel, which surrounds the sleeve so as to define in the zone of its projection an auxiliary damping chamber communicating with the source of compressed gas when the sleeve is in its lower position.

6 Claims, 1 Drawing Figure

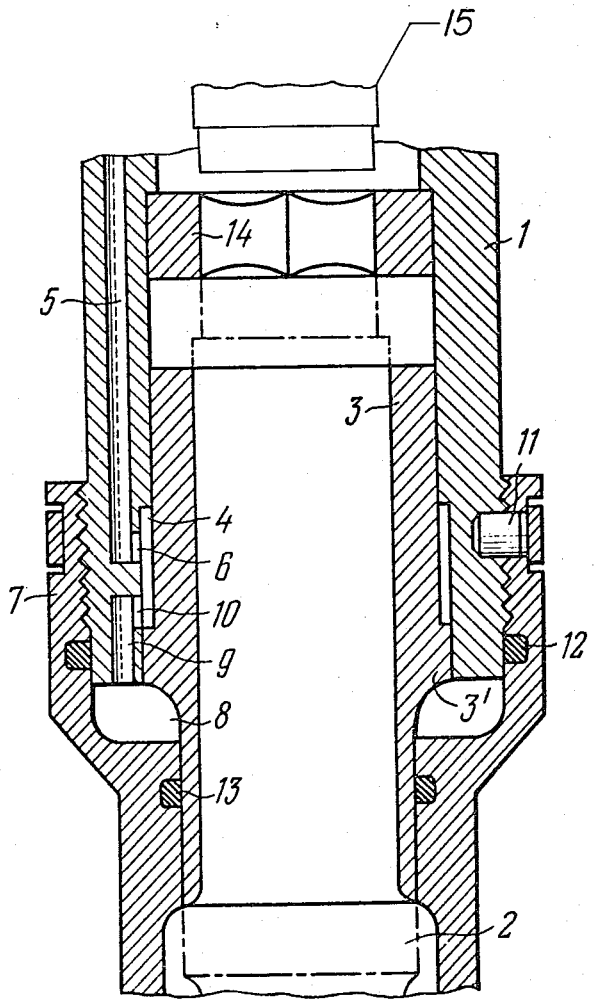
15
14
1
5
3
11
4
6
7
10
12
9
3'
8
13
2

IMPACT TOOL WITH DAMPING CHAMBERS

FIELD OF THE ART

The invention relates to the mechanical engineering, and more particularly, to pneumatic percussive tools to be used in various industries, e.g. in the construction and mining industries, and in the foundry and the like.

BACKGROUND OF THE INVENTION

Known in the art are pneumatic percussive tools, wherein a vibration damping device secured to the lower portion of the tool casing comprises a sleeve having a working tool which is received therein and has a piston which divides the interior of the sleeve into two chambers of which one chamber behind the piston communicates with the working chamber of the pneumatic tool, and the other chamber in front of the piston communicates with atmosphere. This construction of the vibration damping device in a pneumatic percussive tool is disadvantageous in that the provision of a piston on the working tool complicates the tool and makes it more expensive. In addition, constant soiling of working surfaces of the piston and sleeve results in a rapid wear thereof so that the tightness of the chamber behind the piston is lost, and the working tool which recoils from the workpiece breaks through the air cushion of the chamber in front of the piston and hits directly against the tool casing (cf. USSR Inventor's Certificate No. 338362).

Known in art is also a pneumatic percussive tool comprising a barrel having an annular groove in the front end portion and a hammer piston in the barrel, a working tool received in the barrel for axial movement, a floating sleeve which is axially movable and which surrounds the working tool, a damping chamber defined by opposite end faces of the floating sleeve and barrel, respectively, which communicates with a compressed air source and has an outer annular projection (cf. USSR Inventor's Certificate No. 712245).

Though this device is more reliable than that described above, it is deficient in that when the working tool is jammed in the floating sleeve, the blows are transmitted through the sleeve to the tool casing thus bringing about increased vibrations acting on the operator.

SUMMARY OF THE INVENTION

It is an object of the invention to improve the efficiency of vibration reduction in a pneumatic percussive tool.

This and other objects are accomplished by that in a pneumatic percussive tool, wherein a working tool is inserted in a barrel having a hammer piston and an annular groove in the front end portion on the side of the working tool. A floating is axially movable in the barrel which surrounds the working tool and has a projection defining with the barrel groove a damping chamber communicating with a compressed gas source. According to the invention, there is provided a shell secured to the barrel and surrounding the sleeve so as to define in the zone of its projection an auxiliary damping chamber communicating with a source of compressed gas when the floating sleeve is in the lower position.

The advantage of this construction resides in that, owing to the provision of the auxiliary damping chamber define by the shell, the blows transmitted to the sleeve through the working tool shank upon both direct and reverse strokes of the sleeve are damped so as to substantially improve vibration reduction in pneumatic percussive tools.

BRIEF DESCRIPTION OF THE DRAWING

The invention will now be described with reference to a specific embodiment illustrated in the accompanying drawing showing a general view of the lower portion of a pneumatic percussive tool according to the invention, in section.

DESCRIPTION OF PREFERRED EMBODIMENT

A pneumatic percussive tool comprises a barrel 1 in which is arranged a hammer piston 15 for an axial movement for striking at regular intervals at a working tool 2. A floating sleeve 3 surrounding the working tool is provided in the end portion of the barrel. The floating sleeve 3 is of a stepped configuration, the annular projection 3' of the floating sleeve being arranged in the annular groove of the front end portion of the barrel so as to define a damping chamber 4 which communicates with a source of compressed air (not shown) through a passage 5 and a port 6. The annular projection 3' of the floating sleeve 3 and a shell 7 rigidly secured to the front end portion of the barrel 1 and surrounding the floating sleeve define in combination an auxiliary damping chamber 8 communicating with a source of compressed air through the damping chamber 4, via a passage 9 and a port 10 when the floating sleeve is in its lower position. The shell 7 may be secured to the front end portion of the barrel by any means. A pin 11 is used for the purpose as shown in the Figure. The auxiliary damping chamber is sealed by means of sealing members 12 and 13.

The working tool is held against rotation by a profiled bushing 14.

The pneumatic percussive tool according to the invention functions in the following manner. In the position shown in the drawing compressed air from an air supply line is admitted along the passage 5 and through the port 6 to the damping chamber 4 and from the chamber 4, through the port 10 and the passage 9, to the auxiliary damping chamber 8.

When blows are delivered at the shank of the working tool 2, it penetrates into a workpiece, wherein, in addition to deformations causing the destruction of the workpiece, deformations causing the working tool to recoil from the workpiece also occur so that the working tool strikes with its collar against the lower end of the floating sleeve 3. Under the action of energy received due to the blow, the sleeve 3 moves toward the bushing 14. Compressed air in the damping chamber 4 absorbs the energy of movement of the sleeve 3 and stops it so that the sleeve cannot deliver a blow to the barrel 1 of the tool. When there are no blows, the floating sleeve 3 is returned back to the initial position under the action of compressed air pressure in the damping chamber 4.

As a result of misalignment or during the braking operation of tool the sleeve intimately engages the shank of the working tool 2, and, when there is no resistance on the part of the workpiece, starts moving toward the shell 7 together with the working tool. Compressed air in the auxiliary chamber 8 then absorbs the energy of movement of the sleeve 3 to stop it so as not to permit it to deliver a blow at the shell 7, hence at the tool casing.

It is very important for the operation of the pneumatic percussive tool according to the invention that the force acting on the floating sleeve on the side of the auxiliary damping chamber 8 be greater than that acting on the side of the damping chamber 4. Under the action of this force the floating sleeve 3 starts moving toward the bushing 14. Thus the sleeve 3 covers the port 10 with its annular projection thereby interrupting the compressed air admission to the auxiliary damping chamber 8. As the sleeve 3 continues, to move, pressure in the chamber 8 drops and, under the action of the force on the side of the damping chamber 4 which permanently communicates with a source of compressed air, the floating sleeve 3 returns back to the initial position.

We claim:

1. A pneumatic percussive tool, comprising:

a barrel;

a hammer piston reciprocatingly mounted in said barrel;

a sleeve in said barrel;

said sleeve having an external annular projection defining with said barrel an auxiliary damping chamber and a second damping chamber;

said sleeve being axially movable between two extreme positions;

a working tool having a collar engaging the end of said sleeve on the side of said auxiliary damping chamber;

a supply passage in said barrel permanently connecting said second damping chamber with a compressed fluid source;

a first part in said barrel for connecting said supply passage with said auxiliary damping chamber;

a second port in said barrel communicating with said second damping chamber;

said compressed fluid acting with greater force on said sleeve on the side of said auxiliary damping chamber than on the side of said second damping chamber;

both said ports communicating with said auxiliary damping chamber when said sleeve 18 is in the first of said extreme positions;

said first port being closed when said sleeve is in the second of said extreme positions.

2. The tool of claim 1, further including a profiled bushing in said barrel for preventing rotation of said working tool.

3. The tool of claims 1 or 2, further including a shell secured to said barrel and defining with said annular projection of said sleeve part of said auxiliary damping chamber.

4. The tool of claim 3, further including sealing members between said sleeve and said shell for sealing said auxiliary damping chamber.

5. The tool of claim 3, wherein said shell includes an enlarged front portion adapted to receive the shank of said working tool.

6. In a pneumatic percussive tool, wherein a working tool is inserted in the front end of a barrel having a hammer piston at its other end and an annular groove in said front end near said working tool;

a floating sleeve mounted for axial movement in said barrel surrounding said working tool;

said sleeve having an annular projection defining with the barrel groove a damping chamber communicating with a source of compressed gas;

the improvement consisting of a projecting shell rigidly secured to said barrel and surrounding said sleeve so as to define in the zone of the projection thereof an auxiliary damping chamber communicating with a source of compressed gas when said floating sleeve is in its lower position;

said auxiliary damping chamber communicating with said damping chamber through a passage provided in said barrel.

* * * * *